US006209280B1

(12) United States Patent
Bruce et al.

(10) Patent No.: US 6,209,280 B1
(45) Date of Patent: Apr. 3, 2001

(54) JIG FOR SUPPORTING FASCIA BOARD INSTALLATION

(76) Inventors: Ray F. Bruce, 12296 Lakeshore N., Auburn, CA (US) 95602; Stephen Bruce, 871 SE. First St., Broeson, OR (US) 97411; Noah D. Bruce, 14726 Sandpiper Pl., Brookings, OR (US) 97415

( * ) Notice: Subject to any disclaimer, the term of this patent is extended or adjusted under 35 U.S.C. 154(b) by 0 days.

(21) Appl. No.: 09/024,817

(22) Filed: Feb. 17, 1998

(51) Int. Cl.[7] ..... B25B 11/02

(52) U.S. Cl. ..... 52/702; 52/92.2; 52/127.1; 52/713; 52/714; 269/904

(58) Field of Search ..... 52/92.1, 92.2, 52/127.1, 127.2, 289, 702, 713, 714; 269/904, 910

(56) References Cited

U.S. PATENT DOCUMENTS 3,000,145 * 9/1961 Fine ..... 52/92.2 X
4,449,335 * 5/1984 Fahey ..... 52/713 X
5,192,059 * 3/1993 Silver ..... 269/904 X
5,303,520 * 4/1994 Gozdziak ..... 52/92.2
5,442,887 * 8/1995 Welsh ..... 52/92.2
5,526,628 * 6/1996 Knudson .
5,546,726 * 8/1996 Stalzer ..... 52/714 X
5,611,189 * 3/1997 Fleck ..... 52/702
5,664,391 * 9/1997 Bartholomew ..... 52/714
5,666,766 * 9/1997 Markey .
5,857,295 * 1/1999 Mikawa ..... 52/92.2

* cited by examiner

*Primary Examiner*—Carl D. Friedman
*Assistant Examiner*—Timothy B. Kang
(74) *Attorney, Agent, or Firm*—Robert S. Smith

(57) ABSTRACT

A jig for aiding in securing a fascia board on the downwardly extended ends of a row of eaves of a frame of a building being constructed including a U shaped member and an angle bracket with an angle bracket with one leg swivelly attached to an end of one leg of the U shaped member. Two jigs are used for temporarily supporting the board across the ends of the row of eaves permitting that the board be nailed to the ends of the eaves. The jig is preferably made of resiliently flexible polycarbonate so that the jig can be twisted when required to enable aligning of the board in a required direction.

3 Claims, 1 Drawing Sheet

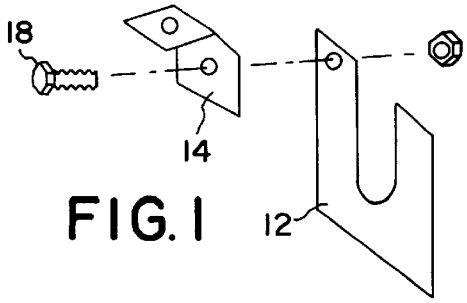
FIG. 1
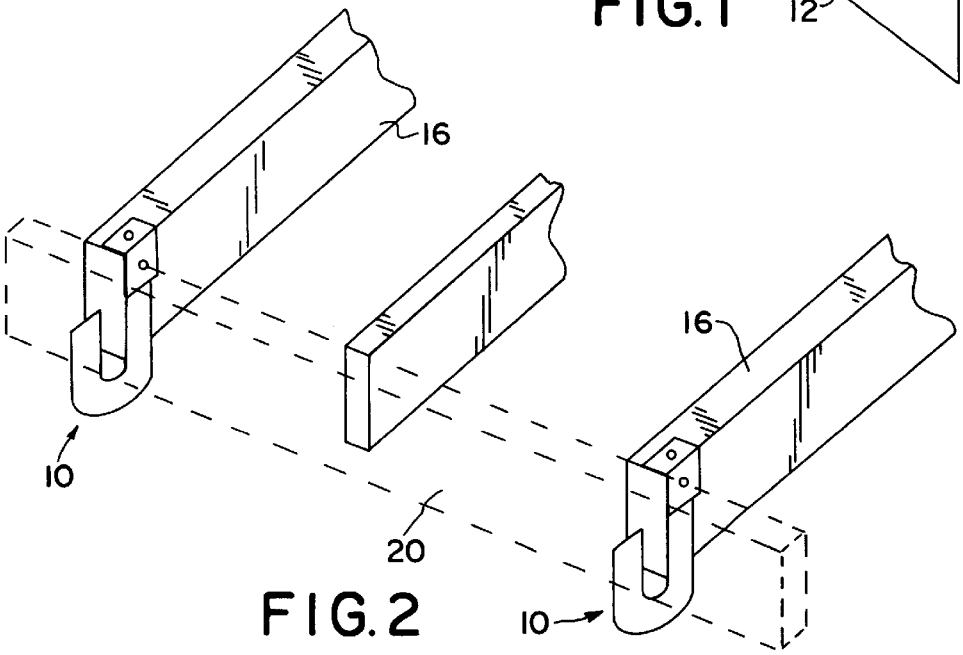
FIG. 2
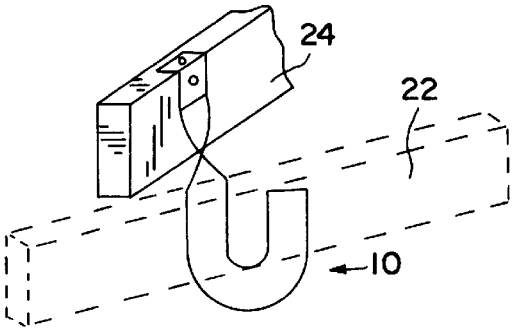
FIG. 3
1. SECURE FIRST SUPPORT
2. SECURE SECOND SUPPORT
3. HANG BOARD
4. NAIL BOARD
5. REMOVE SUPPORTS
FIG. 4
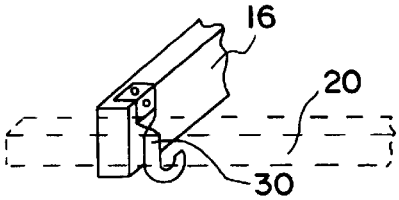
FIG. 5

JIG FOR SUPPORTING FASCIA BOARD INSTALLATION

FIELD OF THE INVENTION

This invention relates to frame construction for a building and particularly to a jig for supporting the fascia board while it is being nailed to the end of the eaves of the roof frame.

BACKGROUND AND INFORMATION DISCLOSURE

The typical construction of the roof section of frame for a building includes a number of parallel "eaves" that extend from peak beam of the roof down a lower edge where the rain gutter is mounted. The eaves are conventionally spaced sixteen inches apart. According to construction practice, after the eaves have been secured in place, a fascia board is nailed across the lower ends of the eaves, The operation of securing the fascia board in place requires that the board be held horizontally against all of the ends of the eaves by two carpenters, one carpenter supporting each end of the board. This is a very dangerous operation since it requires that each carpenter must somehow support himself usually at least two stories from the ground, support his end of the board and simultaneously hammer a nail through the fascia board and the end of the eave.

Various methods and designs for constructing frame buildings have appeared in the patent literature.

For example, U.S. Pat. No. 5,66,766 to Markey discloses a "kit" for building a frame building.

U.S. Pat. No. 5,526,628 to Knudson discloses a building constructed from panels that are roll-formed on the job site.

SUMMARY OF THE INVENTION

It is an object of this invention to provide a jig that is useful for constructing the frame of a conventional frame building.

It is a further object that the jig be especially adapted to support the fascia board while it is being secured to the ends of the eaves of the frame. It is still another object that the carpenter can secure the fascia board to the ends of the eaves by himself and that the operation be performed safely.

This invention is directed toward a jig best described as a cutout from a plastic panel having a shape of the letter U. One leg of the letter U is longer than the other leg. A short angle bracket has one leg swivelly bolted to the face of the long leg of the cutout and another leg extending at a 90° from the face of the cutout. The jig is temporarily mounted to the end of one of the eaves by a nail.

One such jig is secured to the lower end of the eave at one end of the row of eaves and another such jig is secured to the lower end of the eave at the other end of the row of eaves. One end of the fascia board is supported by one jig and the other end of the fascia board is supported by the other jig. The jigs are removed after the fascia board has been secured.

The jig is made preferably from clear polycarbonate about one quarter inch thick and is resiliently flexible. Polycarbonate about one quarter inch thick is preferred because it is very strong and has a desired degree of resiliency that enables a user to flex the jig to support boards at inclinations other than perpendicular when required.

BRIEF DESCRIPTION OF THE DRAWINGS

FIG. 1 shows the two cutouts comprising the jig of this invention.

FIG. 2 shows a pair of jigs supporting a fascia board against the ends of sloping eaves.

FIG. 3 shows a jig that has been flexed to support a beam inclined relative to another beam.

FIG. 4 shows a flow chart of the method of the invention for securing the fascia board.

FIG. 5 shows another embodiment of the jig of this invention.

DESCRIPTION OF AN ILLUSTRATIVE EXAMPLE

Turning now to a discussion of the drawings, FIG. 1 shows exploded the two parts of the jig 10 of this invention including a "U-shaped" cutout 12 and a short angle bracket 14. The angle bracket 14 is secured to the cutout by a single bolt 18 through one leg of the bracket and cutout.

FIG. 2 shows a pair of assembled jigs 10 each mounted on a pair of eaves 16 at opposite ends of a row of eaves 18 (three eaves are shown). A fascia board 20 (shown in phantom) is supported by the jigs 10 and is in position for being nailed to the ends of the eaves 16.

FIG. 3 shows a jig 10 of this invention that has been temporarily twisted to support a first board 22 inclined to a beam 24.

FIG. 4 is a flow chart listing the steps for performing the method of this invention.

In step 1, a user attaches a first fascia board support of this invention to the lower extending end of an eave being on one end of a row of eaves forming the roof frame of a building being constructed.

In step 2, the user attaches a second fascia board support of this invention to the lower extending end of an eave being on an opposite end of the row of eaves.

In step 3, the user hangs the fascia board horizontally on the ends of the row of eaves by engaging each end of the fascia board in a respective one of the supports.

In step 4, the user nails the fascia board to each one of the eaves.

In step 5 the user removes the supports of this invention.

The two parts, 12 and 14, of the jig 10 are preferably made from polycarbonate plastic because of its strength and resilient flexibility compared to other plastics.

The advantage in using this device to secure fascia boards is that one carpenter can perform the entire operation of securing the board to the ends of the eaves. This is accomplished by simply securing one support on one end of the row of eaves and then securing another support on the opposite end of the row of eaves and then hanging the fascia board horizontally with an end engaged in each support. Finally nailing the board to the ends of the eaves and removing the supports. Each of these steps is conveniently a one man operation.

Variations and modifications of the supports and method of performing the operation may be suggested by reading the specification and studying the drawings which are within the scope of the invention.

As shown in FIG. 5, the jig may be a bent strap 30 with one end of an bracket angle 32 secured to eave 16 and the other leg of the angle bracket swivelly attached to the leg of the strap. The jig is shown supporting a fascia board 20 (in phantom).

The strap is preferably made of polycarbonate plastic because of its superior strength and flexible resiliency compared to other materials such as a metal alloy or any of the well known plastics.

For example the jig may be used to support boards in a location other than on the ends of eaves. It is therefore intended that the scope of the invention be defined by the appended claims.

What is claimed is:

1. A jig for temporarily supporting a fascia board in a horizontal orientation in a location against a frame of a building being constructed permitting said board to be secured permanently to building members of said frame which comprises:

a thin flat hook member having a U shape including a pair of legs, each leg having one end joined to said other leg by a joining member;

said pair of legs and joining member all lying in the same plane and said hook member having a thickness measured perpendicular to said plane and an overall width and length measured parallel to said plane;

an angle bracket having two angle legs, one angle leg joined perpendicularly along one edge to an edge of said other leg;

a fastener swivally fastening a flat side of one said angle leg against a flat side of another end of one leg of said said hook member operably arranged to provide that another angle leg of said angle bracket is enabled to be fastened to a location of said frame and said hook member is enabled to engage said fascia board permitting said board to be permanently secured to said frame, said thin flat hook member having said thickness and width and made from a material having a flexibility selected to enable a worker to secure said another leg of said angle bracket to a beam of said frame and twist said jig to engage and support said fascia board inclined to a beam 24 in a position for permanently fastening said fascia board to said beam and providing that said hook member returns to its original flat shape after said hook member is released from said fascia board.

2. The jig of claim 1 wherein said location of said frame is one of the ends of a downwardly extending row of eaves.

3. The jig of claim 1 wherein said hook member is made from polycarbonate plastic.

* * * * *